United States Patent [19]

Gendey et al.

[11] Patent Number: 4,658,871

[45] Date of Patent: Apr. 21, 1987

[54] VALVE FOR FILLING A GAS CONTAINER

[76] Inventors: Yves Gendey, 74800 Esery-Reignier, France; Conrad Zellweger, 5, chemin des voirons, 1224 Chêne-Bougeries, Switzerland

[21] Appl. No.: 723,956

[22] PCT Filed: Jul. 26, 1984

[86] PCT No.: PCT/CH84/00117

§ 371 Date: Apr. 11, 1985

§ 102(e) Date: Apr. 11, 1985

[87] PCT Pub. No.: WO85/00871

PCT Pub. Date: Feb. 28, 1985

[30] Foreign Application Priority Data

Aug. 15, 1983 [CH] Switzerland ..... 4435/83

[51] Int. Cl.[4] ..... B65B 3/18

[52] U.S. Cl. ..... 141/293; 141/18; 141/20; 141/291

[58] Field of Search ..... 141/18, 19, 20, 21, 141/285–290, 291–296, 2–5

[56] References Cited

U.S. PATENT DOCUMENTS

| | | | |
|---|---|---|---|
| 2,769,325 | 11/1956 | Storch | 141/310 |
| 3,039,499 | 6/1962 | Peterson | 141/18 |
| 3,211,194 | 12/1965 | Projahn | 141/295 |
| 3,228,435 | 1/1966 | Kanamaru | 141/286 |
| 3,277,674 | 10/1966 | Klein et al. | 141/20 X |
| 3,391,716 | 7/1968 | Projahn | 141/293 |
| 3,473,704 | 10/1969 | O'Donnell | 141/292 X |

FOREIGN PATENT DOCUMENTS

| | | | |
|---|---|---|---|
| 655196 | 1/1963 | Canada | 141/293 |
| 1167080 | 4/1964 | Fed. Rep. of Germany | 141/294 |
| 1751671 | 5/1971 | Fed. Rep. of Germany . | |
| 355167 | 8/1961 | Switzerland . | |
| 632818 | 10/1982 | Switzerland . | |
| 945129 | 12/1963 | United Kingdom . | |

*Primary Examiner*—Stephen Marcus
*Assistant Examiner*—Ernest G. Cusick
*Attorney, Agent, or Firm*—Anthony A. O'Brien

[57] ABSTRACT

The valve comprises a stationary part (1, 2), a mobile part (9) and a fluid-tight seal (15). This fluid-tight seal (15) consists of two portions (16, 17) axially separated by a cylindrical part (18). During filling, the connection (30) of the recharging tank moves the mobile part (9) downward against the action of a spring (10). A projection (31) works with the portion (16) of the seal to bring this latter downward. A ramp (32) guides the portion (17) of the seal to the connection (30). At the end of the path, this portion (17) is squeezed between the stationary part (1, 2) and the connection to assure a complete fluid-tightness of the filling passage (25) to the outside and a perfect separation of the two filling (25) and escape (21) passages. In the closed position of the valve, the upper part of the part (9) is engaged in the opening provided for the passage of the connection (30).

2 Claims, 2 Drawing Figures

VALVE FOR FILLING A GAS CONTAINER

BACKGROUND OF THE INVENTION

This invention relates to a valve for filling a liquefied gas container by means of a recharging tank equipped with a cylindrical filling neck, the valve including at least a stationary part, a mobile part mounted to slide in an axial chamber of the stationery part and a fluid-tight seal, the axial chamber communicating with an opening on an outside face of the stationary part. The valve includes two passages, one being a passage for refilling the liquefied gas and the other an escape or vent passage to join the inside of the container in communication with the outside. The valve is intended to be activated by the introduction of the filling neck into the axial chamber to move the mobile part and the seal against the action of a spring from a closed position, where the seal is in contact with the stationary part and the mobile part so as to block the two passages, to a filling position where the seal is in contact with the stationary part and the filling neck to open the two passages.

A valve of this type, intended particularly to equip a gas lighter, is described in Swiss Patent No. 355,167 which discloses a seal consisting of an O-ring housed in a groove of the stationary part opposite the opening of the escape passage.

Valves of this type are normally equipped with a cover of plug which must be removed to allow filling. Experience shows that this plug is often lost through use. Moreover, this plug is generally screwed on, which complicates the filling operation. Less often, the plug is introduced with friction into the opening and in this case, it is of a relatively complicated manufacture, because if it is desired that it be flush with the face of the container which is equipped with the valve, it must exhibit a retractable element that can be extended to allow its removal, when filling must be done.

This invention has as its object to eliminate the risk of losing the plug while making possible the closing of the opening for filling by an element constituting a portion of the face of the container which is equipped with the valve, when this latter is in a closed position.

SUMMARY OF THE INVENTION

For this purpose, the valve according to the invention is characterized in that the mobile part includes an end portion whose dismeter corresponds to that of said opening, this end part being shaped so that in the closed position of the valve this part is located approximately in the plane of the outer face of the stationary part.

According to an advantageous embodiment, the fluid-tight seal comprises a unitary element having two portions axially separated by a cylindrical part. A first of these two portions is in contact with the mobile part and cooperates therewith to move the seal from a first position to a second position when the mobile part is moved from the closed position to the filling position. The second portion of the seal is formed so as to block the escape passage when the seal is in said first position and wherein it is subsequently squeezed between the cylindrical filling neck and the walls of the axial chamber of the stationary part, in a position separated from the escape passage, when the seal is axially displaced to said second position.

As a result of this particular arrangement of the seal having two portions axially separated by a cylindrical part, the seal is shifted, during filling, by the mobile part into such a position that it assures a complete blockage between the filling neck and the stationary part of the valve and a perfect isolation of the filling and escape passages. This design makes it possible to make a valve with a very safe operation capable of working with a recharging tank equipped with a simple cylindrical end.

BRIEF DESCRIPTION OF THE DRAWING

The accompanying drawing shows diagrammatically and by way of example an embodiment of the valve, which is the object of the invention.

DESCRIPTION OF THE PREFERRED EMBODIMENT

Figure 1:
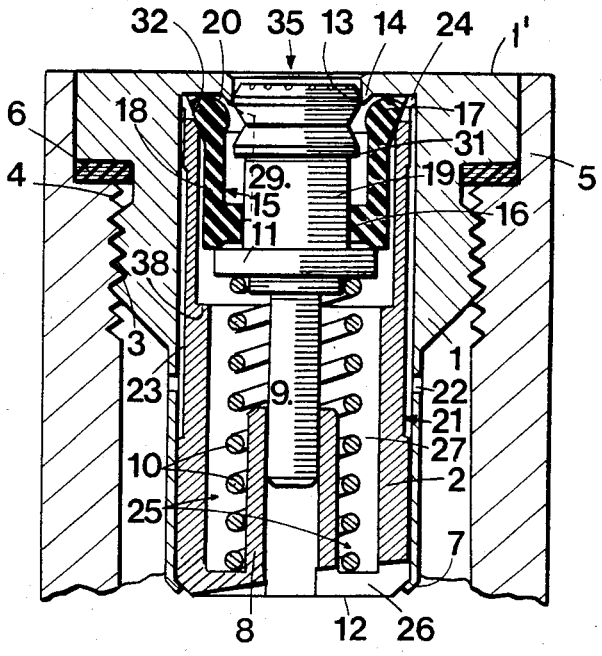
FIG. 1 is a view in longitudinal section of the valve in the closed position.
Figure 2:
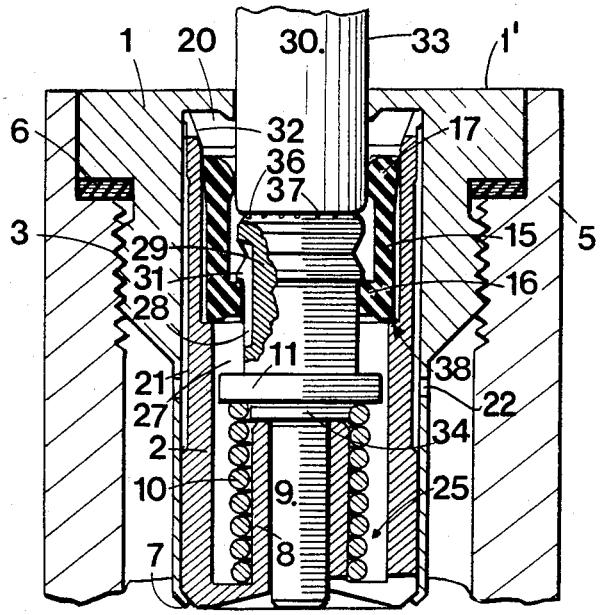
FIG. 2 shows the same valve in a filling position.

The valve described with reference to FIGS. 1 and 2 comprises a stationary part consisting of two parts 1 and 2. Part 1 includes an outside face 1' and a threaded portion 3 that makes it possible to fasten the valve in a corresponding threaded bore 4 of a liquefied gas container 5 in order to permit filling thereof. The fluid-tightness between the valve and container 5 is assured by a seal 6. Lower edge 7 of part 1 is bent to hold in position part 2, the latter having a projecting tubular portion 8. A mobile part 9 is mounted to slide axially in this tubular portion 8 as well as in an axial chamber 27 of the valve and is subjected to the action of a spring 10 resting, on the one hand, against a radial projection or shoulder 11 of the mobile part and, on the other hand, against bottom 12 of stationary part 2. The mobile part 9 exhibits at its upper part a portion 13 that penetrates into an opening 35 of the body of the valve part 1, which is delimited by an inner edge 14. Upper face 36 of this portion 13 of the mobile part comprises at least a radial groove 37 intended to facilitate the flow of the liquefied gas. In the closed position of the valve shown in FIG. 1, the upper face 36 of part 9 is disposed approximately in the plane of the outer face of part 1.

The valve shown comprises a fluid-tight elastomer seal 15 comprising first and second annular portions 16, 17 axially separated by a cylindrical part 18. A first or lower one 16 of these two annular portions includes a section one face of which rests against the cylindrical wall or side 19 of mobile part 9 and a second face of which is applied against shoulder 11, when the valve is in the closed position. In this position, the other or upper annular portion 17 of the seal is urged by spring 10 into a housing 20 provided in the upper part of the stationary part 1. The inside of the liquefied gas container 5 communicates with this housing 20 through an escape or vent passage 21 consisting of a bore 22 through part 1, a cylindrical space 23 between the two stationary parts 1, 2 and of openings 24 that end in housing 20. Subjected to the action of spring 10 against the mobile part 9, seal portion 17 completely blocks openings 24 of the escape passage, when the valve is closed.

This escape passage is entirely separated from the filling passage 25 for the liquefied gas. This latter passage includes openings 26 provided in bottom 12, the axial chamber 27 and longitudinal grooves 28 formed in upper part 29 of mobile part 9 (FIG. 2). These grooves 28 do not extend to shoulder 11 so as to allow the blocking of filling passage 25 by first portion 16 of the seal when the valve is closed.

During the opening of the valve, mobile part 9 is moved by the introduction of cylindrical filling neck 30, of a recharging tank, not shown, in upper opening 35 of the valve. Fluid-tight seal 15 remains immobile until a radial projection 31 of mobile part 9 engages with first portion 16 of the seal. Neck 30 is at this time disposed within the confines of upper portion 17 of seal 15, but is not engaged by same. Part 2 of the stationary part comprises, at housing 20, a ramp 32 against which portion 17 of the seal is pressed. This ramp 32 is formed so as to bring portion 17 to a position radially more inside the valve to urge portion 17 into contact with cylindrical wall 33 of neck 30, when seal 15, in contact with projection 31, is moved downward by mobile part 9 (see FIG. 2). After arriving at the lower part of this ramp 32, portion 17 of seal 9 is entirely squeezed between neck 30 and part 2 of the stationary part to assure a complete fluid-tightness of filling passage 25 relative to the outside of the valve and container. Mobile part 9 is stopped in its downward path by a washer 34 that strikes against the upper part of stationary tubular portion 8, while seal 15 rests with its portion 16 against a shoulder 38 on part 2. An additional pressure on the recharging tank makes it possible to open the check valve of this latter against the action of a spring, not shown. It is important that spring 10 be selected so that its force is weaker than that of the springs used in the valves of marketed recharging tanks.

Neck 30 is introduced into opening 35 and moves mobile part 9 downward against the action of spring 10. At this time, the neck is not in contact with upper portion 17 of fluid-tight seal 15.

Projection 31 on the mobile part then drives seal 15 downward by engagement with seal lower portion 16. There is now provided an opening for vent or escape passage 21 due to exposure of openings 24. Portion 17 of the seal, guided by ramp 32 are urged into contact with neck 30 and squeezed against this latter. Filling passage 25 is now entirely closed to the outside.

Washer 34 strikes against tubular portion 8. An additional pressure on the recharging tank makes it possible to open the check valve of the tank and allow the flow of the liquefied gas through the filling passage 25 in container 5.

When the container is filled, liquefied gas escapes through the vent or escape passage 22, 23, 24. The user is thus notified that the container is full and he must withdraw the neck and recharging tank. The check valve of this latter is closed under the action of its spring.

Mobile part 9 urged by spring 10 then rises. When lower portion 16 of the seal comes in contact with shoulder 11, the intake passage 25, 28 is closed and seal 15 is driven upward by mobile part 9. Seal portion 17 penetrates into housing 20 and blocks openings 24 of the escape passage which, in turn, is then closed. Seal 15 is then squeezed by spring 10 between the upper wall of chamber 20 and mobile part shoulder 11. This assures a fluid-tight closing of container 15 and constitutes a stop to hold part 9 in such a position that its upper face is approximately in the plane of the outside face of the body of the valve.

We claim:

1. Valve for filling a liquefied gas container by means of a recharging tank equipped with a cylindrical neck, this valve including at least a stationary part having an outer face, a mobile part mounted to slide in an axial chamber of the stationary part and a fluid-right seal, the axial chamber having an opening communicating with an outside face of the stationary part, the valve having two passages, one being a passage for filling of liquefied gas and the other a vent passage to join the inside of the container in communication with the outside, this valve being adapted to be acutated by introduction of the neck into the aixal chamber to move the mobile part and the seal against the action of a spring from a closed position, where the seal is in contact with the stationary part and the mobile part so as to block the two passages, to a filling position where the seal is in contact with the stationary part and the neck to open the two passages, characterized in that said fluid-tight seal comprises two annular portions axially separated by a cylindrical part, a first of these two annular portions being in contact with the mobile part and engageable therewith to move the seal axially from a first position to a second position when the mobile part is moved from the closed position to the filling position, the second of said two annular portions of the seal adapted to block the vent passage when the seal is in said first position, and said seal second annular portion adapted to be squeezed between the cylindrical neck and the stationary part in a position unblocking the vent passage, when the seal is displaced axially to said second position, said vent passage adapted to communicate through an opening leading to said axial chamber, said stationary part comprising, near this vent communicating opening, a ramp intended to guide said second annular portion of the seal from a position, where it is separated from the cylindrical neck, to a position where it is held between the stationary part and the cylindrical neck, when the seal is moved axially from said first position to said second position, said mobile part including an end portion whose diameter substantially equals that of said opening communicating with tne outside face of the stationary part, and said end portion being shaped so that in the closed position of the valve said end portion is located approximately in the plane of the outer face of the stationary part.

2. Valve for filling a liquefied gas container by means of a recharging tank equipped with a cylindrical neck, this valve including at least a stationary part having an outer face, a mobile part mounted to slide in an axial chamber of the stationary part and a fluid-tight seal, the axial chamber having an opening communicating with an outside face of the stationary part, the valve having two passages, one being a passage for filling of liquefied gas and the other a vent passage to join the inside of the container in communication with the outside, this valve being adapted to be acutated by introduction of the neck into the axial chamber to move the mobile part and the seal against the action of a spring from a closed position, where the seal is in contact with the stationary part and the neck to open so as to block the two passages, to a filling position where the seal is in contact with the stationary part and the mobile part the two passages, characterized in that said fluid-tight seal comprises two annular portions axially separated by a cylindrical part, a first of these two annular portions being in contact with the mobile part and engageable therewith to move the seal axially from a first position to a second position when the mobile part is moved from the closed position to the filling position, the second of said two annular portions of the seal adapted to block the vent passage when the seal is in said first position, and said seal second annular portion adapted to be squeezed between the cylindrical neck and the stationary part in a position un-blocking the vent passage, when the seal is displaced axially to said second position, said mobile part slidably displaceable relative the seal and comprising two axially spaced radial projections engageable with the first portion of the seal, a first one said projection engageable with said seal first portion to move the seal from the first position to the second position, a second one said projection engageable with said seal first portion to move the seal to the first position, said mobile part including at least a longitudinal groove passing through the first mobile part projection and extending axially from two sides of this first projection so as to allow the passage of the liquefied gas when the seal first portion is in contact with this first projection and the seal occupies said second position, said mobile part in fluid-tight contact with the first portion of the seal when the second projection engages said seal first portion, said mobile part including an end portion whose diameter substantially equals that of said opening, and said end portion being shaped so that in the closed position of the valve said end of the stationary part.

* * * * *